US010676887B2

(12) United States Patent
Reinert

(10) Patent No.: US 10,676,887 B2
(45) Date of Patent: Jun. 9, 2020

(54) ONE-PIECE Z-SHAPED FLAT PLATE FOUNDATIONS AND METHOD OF FORMING SAME

(71) Applicant: Gary L Reinert, Carnegie, PA (US)

(72) Inventor: Gary L Reinert, Carnegie, PA (US)

( * ) Notice: Subject to any disclaimer, the term of this patent is extended or adjusted under 35 U.S.C. 154(b) by 0 days.

(21) Appl. No.: 16/600,832

(22) Filed: Oct. 14, 2019

(65) Prior Publication Data

US 2020/0115876 A1 Apr. 16, 2020

Related U.S. Application Data

(60) Continuation of application No. 15/242,723, filed on Aug. 22, 2016, now abandoned, which is a division of (Continued)

(51) Int. Cl.

| | |
|---|---|
| ***E02D 5/28*** | (2006.01) |
| ***E04H 12/22*** | (2006.01) |
| ***E02D 27/42*** | (2006.01) |
| ***E02D 13/04*** | (2006.01) |
| ***E02D 7/18*** | (2006.01) |

(Continued)

(52) U.S. Cl.

CPC ..... *E02D 5/28* (2013.01); *B21D 47/00* (2013.01); *E02D 5/80* (2013.01); *E02D 7/18* (2013.01); *E02D 13/04* (2013.01); *E02D 27/02* (2013.01); *E02D 27/12* (2013.01); *E02D 27/32* (2013.01);

(Continued)

(58) Field of Classification Search

CPC .. B21D 47/00; E02D 5/28; E02D 5/80; E02D 7/18; E02D 13/04; E02D 27/02; E02D 27/12; E02D 27/32; E02D 27/42; E02D 27/50; E04H 12/2215

See application file for complete search history.

(56) References Cited

U.S. PATENT DOCUMENTS 291,927 A * 1/1884 Newton ..... E04H 12/2215 52/165
589,980 A * 9/1897 Randolph ..... E04H 12/2215 52/154

(Continued)

FOREIGN PATENT DOCUMENTS

WO WO 20130044125 3/2013
WO WO/2016/100343 6/2016

(Continued)

*Primary Examiner* — James M Ference

(74) *Attorney, Agent, or Firm* — Blynn L. Shideler; Krisanne Shideler; BLK Law Group

(57) ABSTRACT

A one-piece, Z shaped steel plate foundation comprising a main plate body extending the longitudinal length of the foundation from a top to a bottom of the foundation, a single rear flange extending perpendicular to the main plate body in a first direction at a rear edge of the main plate body, wherein the single rear flange does not extend past the main plate body in the direction opposite the first direction, a single front flange extending perpendicular to the main plate body in the direction opposite the first direction at a front edge of the main plate body, wherein the single front flange does not extend past the main plate body in the first direction; and a plurality of mounting holes at the top of the one-piece metal plate foundation configured for attachment to the structure to be supported.

13 Claims, 7 Drawing Sheets

Related U.S. Application Data application No. 14/708,608, filed on May 11, 2015, now Pat. No. 9,422,687, which is a division of application No. 14/346,656, filed as application No. PCT/US2012/056699 on Sep. 21, 2012, now abandoned.

(60) Provisional application No. 61/671,488, filed on Jul. 13, 2012, provisional application No. 61/671,469, filed on Jul. 13, 2012, provisional application No. 61/537,803, filed on Sep. 22, 2011.

(51) Int. Cl.

| | |
|---|---|
| ***E02D 5/80*** | (2006.01) |
| ***E02D 27/50*** | (2006.01) |
| ***E02D 27/32*** | (2006.01) |
| ***E02D 27/02*** | (2006.01) |
| ***E02D 27/12*** | (2006.01) |
| ***B21D 47/00*** | (2006.01) |

(52) U.S. Cl.
CPC ..... *E02D 27/42* (2013.01); *E02D 27/50* (2013.01); *E04H 12/2215* (2013.01)

(56) References Cited

U.S. PATENT DOCUMENTS 992,529 A * 5/1911 Abraham ..... A01G 9/20 47/19.1
1,123,105 A * 12/1914 Crews ..... E04H 12/2215 52/165
2,023,155 A * 12/1935 Turner ..... E04H 15/003 135/87
2,349,110 A * 5/1944 Potstada ..... A01G 9/124 52/165
2,980,124 A * 4/1961 Atchison ..... E04H 15/003 135/154
3,242,623 A * 3/1966 Brisse ..... E02D 5/80 52/155
3,305,985 A * 2/1967 Dean ..... E04H 17/10 52/155
3,581,436 A * 6/1971 Basiger ..... A01G 13/0206 47/22.1
3,724,145 A * 4/1973 Daniel ..... E02D 5/801 52/157
3,839,839 A * 10/1974 Tillisch ..... E04B 2/74 52/846
3,861,097 A * 1/1975 Patterson ..... E02D 5/805 52/98
3,896,596 A * 7/1975 Berger ..... E04H 12/2215 52/153
4,096,677 A * 6/1978 Gilb ..... E02D 27/42 405/231
4,252,472 A * 2/1981 Moraly ..... E04H 17/263 173/126
4,320,608 A * 3/1982 Deike ..... E04H 12/2215 248/316.3
4,471,588 A * 9/1984 Schirm ..... E02D 5/801 52/154
4,508,319 A * 4/1985 Tappan ..... E04H 17/14 256/1
4,543,757 A * 10/1985 Cosgrove ..... E02D 27/42 248/158
4,615,156 A * 10/1986 Deike ..... E04H 12/2215 40/612
4,644,713 A * 2/1987 Lehman ..... E04H 12/2215 52/165
4,646,489 A * 3/1987 Feller ..... E04H 12/2253 256/DIG. 5
4,730,423 A * 3/1988 Hughes ..... E04D 13/0335 135/87
4,863,137 A * 9/1989 Cockman ..... E02D 5/801 248/545
4,874,149 A * 10/1989 Miceli ..... E04H 12/2215 248/530
4,882,891 A * 11/1989 Sero ..... E02D 5/72 52/741.15
4,923,164 A * 5/1990 Stenberg ..... E04H 12/2215 248/156
4,923,165 A * 5/1990 Cockman ..... E02D 5/801 248/156
4,974,997 A * 12/1990 Sero ..... E02D 5/72 405/231
5,066,168 A * 11/1991 Holdeman ..... E02D 5/56 405/245
5,067,683 A * 11/1991 Wager ..... F41J 1/10 248/156
5,104,265 A * 4/1992 Halloran, Jr. ..... E04H 12/2215 405/244
5,123,623 A * 6/1992 McNamara ..... E04H 12/2253 248/156
5,150,553 A * 9/1992 Commins ..... E04B 1/0007 52/264
5,230,187 A * 7/1993 Reimann ..... A01K 3/00 52/102
5,322,386 A * 6/1994 Trangsrud ..... E02D 5/80 405/19
5,636,482 A * 6/1997 Klager ..... E04H 12/2292 52/165
5,660,504 A * 8/1997 Reinert, Sr. ..... E02D 7/26 173/184
5,689,918 A * 11/1997 Johnson ..... E04H 12/2215 404/9
5,733,068 A 3/1998 Reinert, Sr.
5,749,180 A * 5/1998 Jewett ..... E04H 12/2215 52/154
5,765,321 A * 6/1998 Barbera ..... E02D 5/805 405/244
5,873,679 A * 2/1999 Cusimano ..... E02D 27/48 405/229
5,944,452 A * 8/1999 Reinert, Sr. ..... E02F 3/963 173/184
6,021,600 A * 2/2000 Everett ..... A01G 9/28 47/33
6,039,298 A * 3/2000 Stier ..... E04H 12/2215 248/156
6,128,867 A * 10/2000 MacKarvich ..... E02D 5/801 52/155
6,202,369 B1 * 3/2001 Partee ..... E04H 12/2269 248/523
6,272,798 B1 * 8/2001 Cockman ..... E02D 5/801 135/118
6,343,446 B1 * 2/2002 Beard ..... E02D 27/42 248/545
6,347,489 B1 * 2/2002 Marshall, Jr. ..... E02D 27/00 248/354.5
6,402,432 B1 * 6/2002 England ..... E02D 5/44 175/267
6,461,084 B1 * 10/2002 Stuart ..... E04H 12/2215 248/156
6,578,826 B2 * 6/2003 Pilcher ..... E04H 12/2292 256/19
6,722,821 B1 * 4/2004 Perko ..... E02D 5/801 405/249
6,866,251 B2 * 3/2005 Rosaen ..... E04H 17/161 256/25
7,003,919 B2 * 2/2006 Riker ..... E04H 12/2269 52/170
7,134,636 B2 * 11/2006 Callies ..... E04H 12/2215 248/530
7,152,841 B2 * 12/2006 Callies ..... E04H 12/2215 248/530
7,627,994 B1 * 12/2009 Demirkan ..... E04H 12/2269 248/530
7,780,139 B2 * 8/2010 Markert ..... E04H 12/2261 135/15.1

(56) References Cited

U.S. PATENT DOCUMENTS 7,921,616 B2 * 4/2011 Reyneveld ..... E02D 27/42 52/295
8,286,925 B1 * 10/2012 White, Jr. ..... A47G 29/1216 248/156
D769,468 S * 10/2016 Pope ..... D25/128
D769,469 S * 10/2016 Pope ..... D25/128
2002/0088186 A1 * 7/2002 Cusimano ..... E02D 5/805 52/162
2002/0095880 A1 * 7/2002 MacKarvich ..... E04B 1/34352 52/169.12
2003/0140578 A1 * 7/2003 Moreno, Jr. ..... E02D 27/01 52/169.1
2004/0000115 A1 * 1/2004 Cox ..... E04H 12/2292 52/514
2004/0206020 A1 * 10/2004 Stuart ..... E04H 12/2215 52/169.1
2005/0188627 A1 * 9/2005 Alberts ..... E02D 5/801 52/166
2005/0232707 A1 * 10/2005 Reinert, Sr. ..... E02D 27/42 405/232
2006/0070313 A1 * 4/2006 Moblo ..... E04G 13/00 52/155
2006/0236647 A1 * 10/2006 Fehr ..... E04C 3/30 405/262
2007/0000187 A1 * 1/2007 St. Onge ..... E02D 5/74 52/157
2007/0056226 A1 * 3/2007 Angelo ..... E02D 27/48 52/169.9
2007/0065233 A1 * 3/2007 Collina ..... E02D 5/28 405/232
2008/0104899 A1 * 5/2008 Hill ..... E04H 12/2215 52/165
2008/0230758 A1 * 9/2008 Reinert ..... E04H 12/2215 256/1
2008/0282625 A1 * 11/2008 Stahm ..... E02D 5/80 52/163
2009/0038240 A1 * 2/2009 Leonard ..... E04B 1/34347 52/169.9
2009/0133337 A1 * 5/2009 Hill ..... E02D 5/80 52/165
2009/0212177 A1 * 8/2009 Beasley ..... F16M 3/00 248/127
2009/0313916 A1 * 12/2009 Zhu ..... E04H 12/2215 52/155
2010/0143048 A1 * 6/2010 Lin ..... E02D 5/523 405/244
2010/0257794 A1 * 10/2010 Stark ..... E02D 5/80 52/158
2011/0204198 A1 * 8/2011 Leary ..... E04F 11/1812 248/346.03
2012/0192507 A1 * 8/2012 Paananen ..... E04H 12/2215 52/155
2014/0237913 A1 * 8/2014 Kronz ..... E02D 5/80 52/169.9
2015/0247336 A1 * 9/2015 Bergman ..... E04H 12/2223 52/157
2016/0024740 A1 * 1/2016 Reinert ..... E02D 5/80 52/169.9
2016/0040386 A1 * 2/2016 Tappe ..... E02D 27/00 405/230
2016/0168816 A1 * 6/2016 Pope ..... E02D 5/223 52/292
2017/0000941 A1 * 1/2017 Nishio ..... B04B 5/0407

FOREIGN PATENT DOCUMENTS

WO WO/2016/100345 6/2016
WO WO/2016/100357 6/2016

* cited by examiner

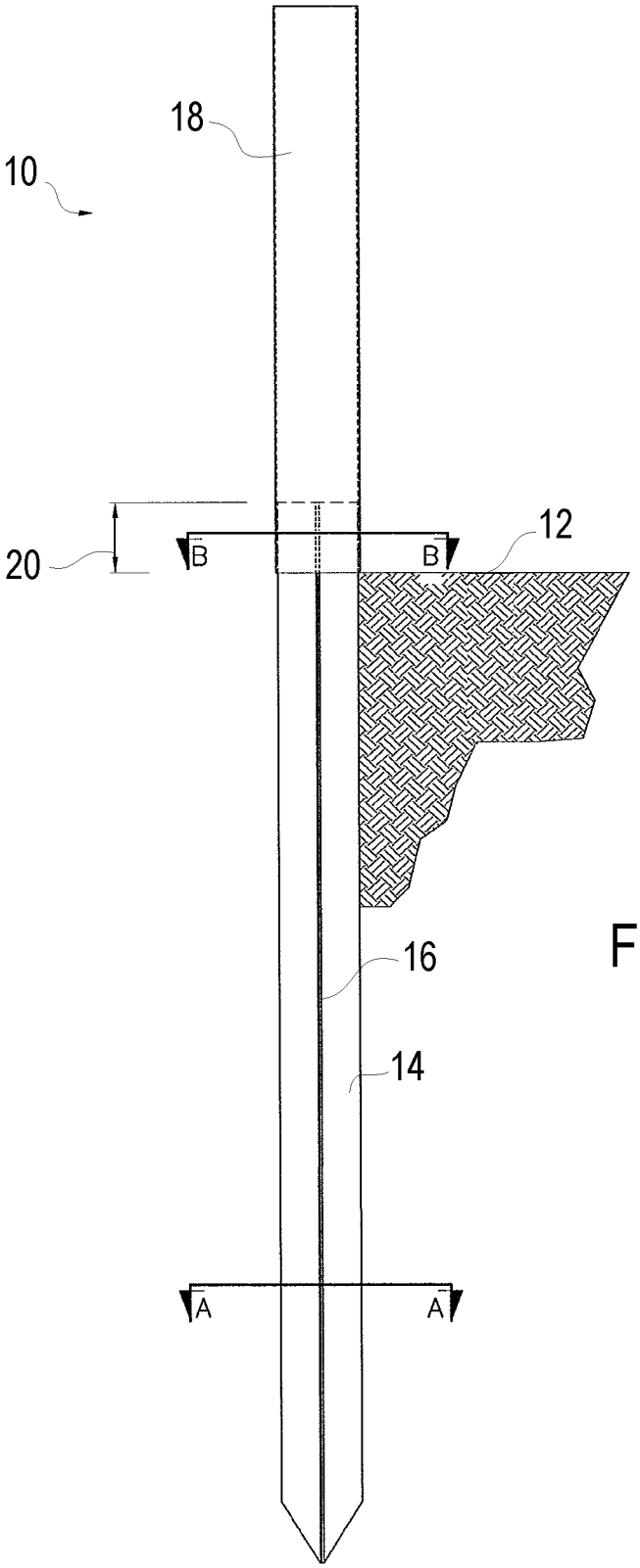
FIG. 1A
FIG. 1B
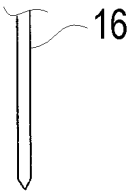
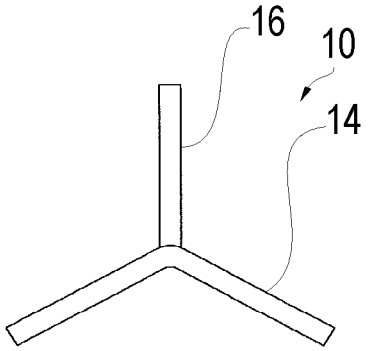
FIG. 2
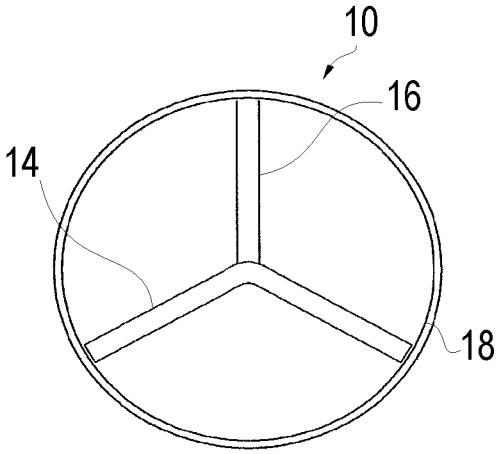
FIG. 3

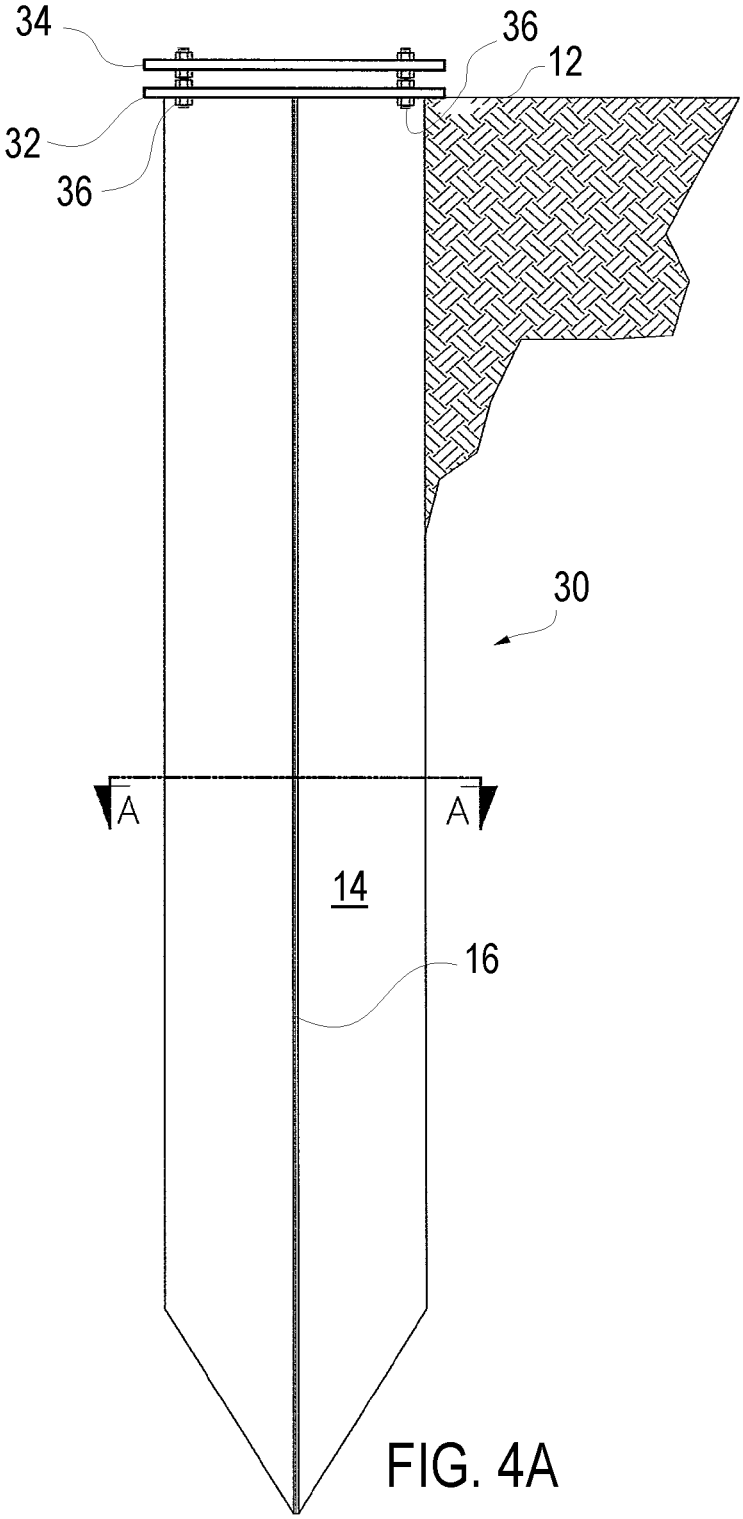
FIG. 4A
FIG. 4B
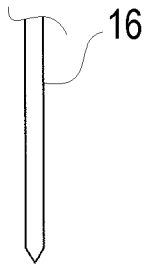

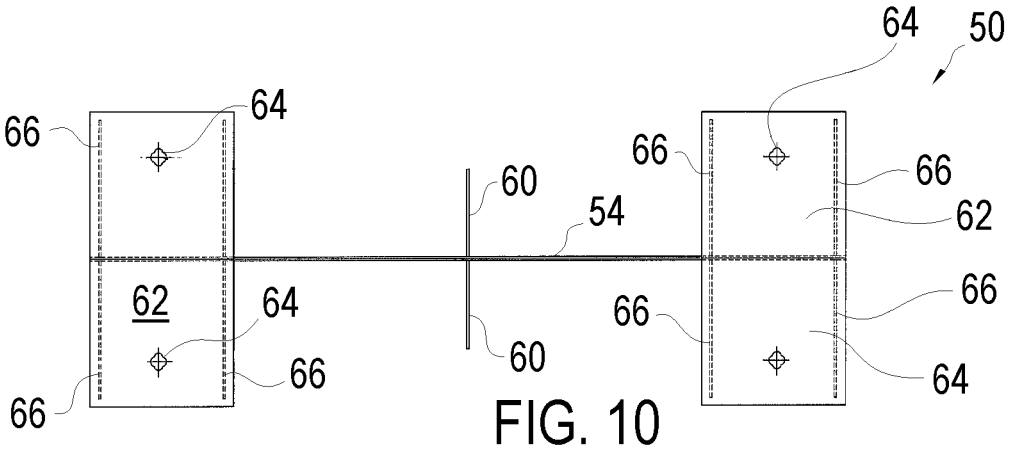
FIG. 10
FIG. 10A
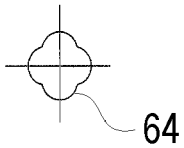
FIG. 12
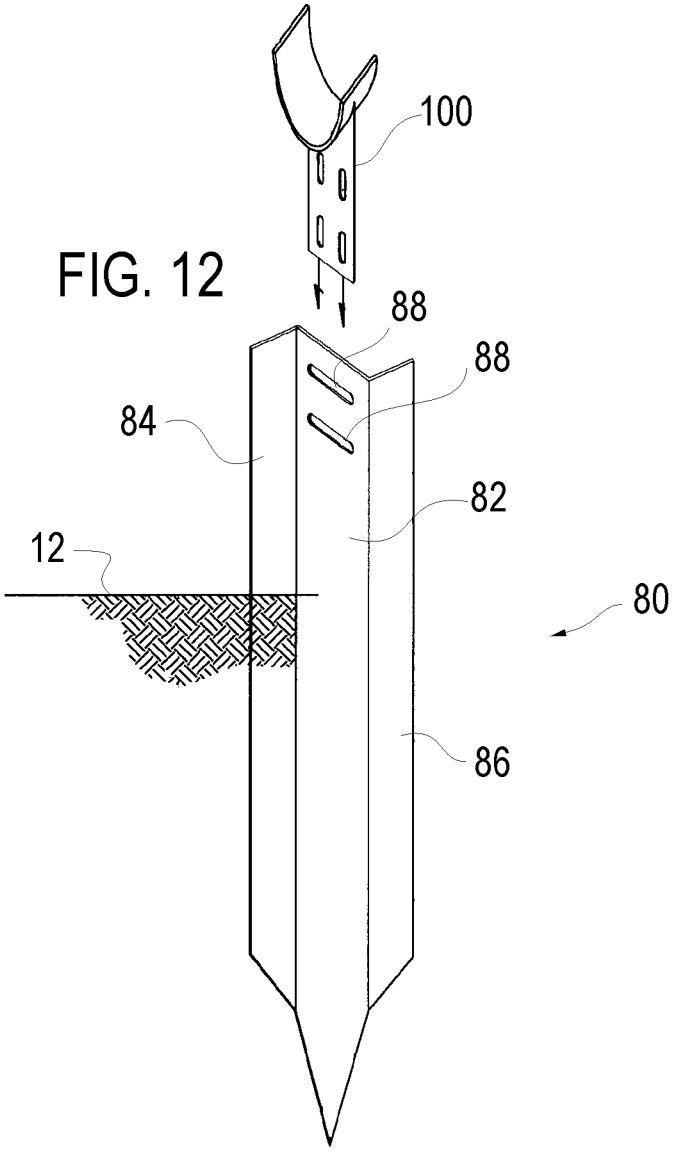

ONE-PIECE Z-SHAPED FLAT PLATE FOUNDATIONS AND METHOD OF FORMING SAME

RELATED APPLICATIONS

This application is a divisional of U.S. patent application Ser. No. 15/242,723 filed Aug. 22, 2016 entitled "ONE-PIECE Z-SHAPED FLAT PLATE FOUNDATIONS AND METHOD OF FORMING SAME" and which published as U.S. Publication US 2017-0009419 A1 on Jan. 12, 2017, and which publication is incorporated herein by reference in its entirety.

U.S. patent application Ser. No. 15/242,723 is a divisional of U.S. patent application Ser. No. 14/708,608 filed May 11, 2015 entitled "Flat Plate Foundation Supports" and which published as U.S. Publication US 2016-0024740 A1 on Jan. 28, 2016, and issued Aug. 23, 2016 as U.S. Pat. No. 9,422,687 and which publication and Patent are incorporated herein by reference in its entirety.

U.S. patent application Ser. No. 14/708,608 is a divisional of U.S. patent application Ser. No. 14/346,656 filed Mar. 21, 2014 entitled "Foundation Apparatus and Method" and which published as U.S. Publication US 2014-0237913 A1 on Aug. 28, 2014 and which publication is incorporated herein by reference in its entirety.

U.S. patent application Ser. No. 14/346,656 is a national stage of International Patent Application Serial Number PCT/US12/56699 filed Sep. 21, 2012 entitled "Foundation Apparatus and Method" and which published as International Publication WO 2013/044125 on Mar. 28, 2014 and which publication is incorporated herein by reference in its entirety.

International Patent Application Serial Number 14/346,656 claims the benefit of provisional Patent Application Ser. Nos. 61/671,469 and 61/671,488 both filed Jul. 13, 2012 and both entitled "Foundation Apparatus and Method." International Patent Application Serial Number 14/346,656 claims the benefit of provisional Patent Application Ser. No. 61/537,803 filed Sep. 22, 2011 entitled "Flat Plate Foundation Supports."

BACKGROUND INFORMATION

1. Field of the Invention

The present invention relates to various flat-plate foundation supports that provide a foundation anchor for various ground supported structures.

2. Background Information

The present invention relates to a foundation apparatus, a method of providing structural support, and method of making, using, and installing the foundation apparatus for structural support. For background consider U.S. Pat. No. 4,882,891, which is incorporated herein by reference, which relates to an apparatus and method for installing a structural anchor or foundation in an earthen hole wherein the foundation includes radial vanes for resisting turning moments. For further similar background see U.S. Pat. No. 4,974,997, this is also incorporated herein by reference, and which discloses a hydraulic setting tool assembly that is particularly useful for installing a structural anchor or foundation in an earthen hole.

U.S. Pat. Pub. No. 2003-0085394, which is incorporated herein by reference, discloses a metal foundation or support post for a guardrail system having a plurality of the vertical support posts supporting a plurality of guardrail beams. Each post includes a pair of flanges having free edge portions with edge folds defining tubular beads on the free edge portions to provide reinforcement and desired to utilize a minimum amount of material usage for the posts.

U.S. Pat. Pub. Nos. 2014-0008594, 2012-0205603, and 2011-0186795, are incorporated herein by reference, disclose a metal foundation or highway guardrail post which comprises an elongated one-piece roll-formed metal body including a front wall defining an attachment face, a pair of opposing side walls orthogonal to the front wall, a first pair of inverted corners respectively connecting the pair of side walls to the front wall, and a second pair of inverted corners respectively extending from the pair of side walls and terminating in a pair of spaced rear edges to define a rear access opening opposite the front wall. The guardrail posts may be manufactured by roll-forming a metal sheet or coil and cutting the roll-formed metal sheet or coil into lengths.

There remains a need in the art for cost effective easy to install foundations. The foundations of the present invention reduces or eliminates the need for specialized installation equipment such as is the case for drilled foundations. The foundations of the present invention also substantially eliminate the expenses associated with the handling and disposal of excavation spoils, placing of concrete reinforcing rods, trucking and placement of concrete, and time delay associated with concrete curing before the foundation can be put in service.

SUMMARY OF THE INVENTION

This invention is directed to a flat-plate foundation support which includes a lower portion extending longitudinally along a central longitudinal axis of the support and adapted for insertion into a ground surface. The lower portion has a plurality of flat plates that are mutually connected along the central longitudinal axis of the support and extend laterally or radially from the central longitudinal axis. The flat plates are beveled and have a sharpened leading edge at a lower end of the lower portion. An upper portion of the support is attached to a top end of the lower portion. The upper portion of the support is attached to a ground supported apparatus to anchor the apparatus to the ground.

According to an embodiment of the present invention, the upper portion is a cylindrical pipe disposed over the top end of the lower portion and having an inner surface attached to the individual flat plates, which extend above the ground surface.

According to another embodiment of the present invention, the upper portion is a top plate that is disposed on the top end of the lower portion such that the plate extends across the top edges flat plates of the lower portion, which are disposed flush with the ground surface such that the top plate is disposed on the ground surface.

According to another embodiment of the present invention, the lower portion of the support includes an elongated plate having a center portion that is beveled, with respect to the longitudinal axis of the lower portion, and a bottom portion that is beveled more sharply, with respect to the longitudinal axis. The leading edge of both the center and bottom portions of the elongated plate are sharpened. The lower portion also includes a pair of side plates disposed on either side of the elongated plate and connected to the elongated plate along the central longitudinal axis. The lower end of the side plates is beveled and includes a sharpened leading edge. The length of the side plates along the central longitudinal axis is shorter than the length of the elongated plate such that the side plates are buried in the ground surface while the top end of the elongated plate extends above the ground surface. The upper portion of the support includes a pair of support plates disposed on top of opposing lateral ends of the elongated plate. The support plates may additionally be supported by one or more triangular gussets extending between the elongated plate and the support plate. One structure, such as an A-frame structure, or plural ground supported structures may be anchored according this embodiment.

According to another embodiment of the invention a one-piece, Z shaped steel plate foundation comprises a main plate body extending the longitudinal length of the foundation from a top to a bottom of the foundation, a single rear flange extending perpendicular to the main plate body in a first direction at a rear edge of the main plate body, wherein the single rear flange does not extend past the main plate body in the direction opposite the first direction, a single front flange extending perpendicular to the main plate body in the direction opposite the first direction at a front edge of the main plate body, wherein the single front flange does not extend past the main plate body in the first direction; and a plurality of mounting holes at the top of the one-piece metal plate foundation configured for attachment to the structure to be supported.

According to another embodiment of the invention a method of forming a one-piece metal plate foundation comprising the steps of: Providing a single flat steel plate wherein a central portion of the single flat plat forms a main plate body extending the longitudinal length of the foundation from a top to a bottom of the foundation; Bending a single rear flange extending at an angle from the main plate body in a first direction at a rear edge of the main plate body; and Bending a single front flange extending at an angle from the main plate body in the direction opposite the first direction at a front edge of the main plate body.

The features that characterize the present invention are pointed out with particularity in the claims which are part of this disclosure. These and other features of the invention, its operating advantages and the specific objects obtained by its use will be more fully understood from the following detailed description in connection with the attached figures.

BRIEF DESCRIPTION OF THE FIGURES

FIG. 1A is a side view of a flat plate foundation support according to one embodiment of the present invention.

FIG. 1B is an enlarged side view of a single fin of the flat plate foundation support shown in FIG. 1A.

FIG. 2 is a cross-sectional view of the foundation support taken along lines "A-A", shown in FIG. 1A.

FIG. 3 is a cross-sectional view of the foundation support taken along lines "B-B", shown in FIG. 1A FIG. 4A is a side view of a flat plate foundation support according to another embodiment of the present invention.

FIG. 4B is an enlarged side view of a single fin of the flat plate foundation support shown in FIG. 4A.

FIG. 10 is a top plan view of the flat plate foundation of FIG. 8A.

FIG. 10A is an enlarged top plan view of an adjustable mounting hole configuration of the flat plate foundation of FIG. 10.

FIG. 12 is a perspective view of a one-piece, z-shaped flat metal plate foundation support according to one embodiment of the present invention;

DESCRIPTION OF THE PREFERRED EMBODIMENTS

Figure 5:
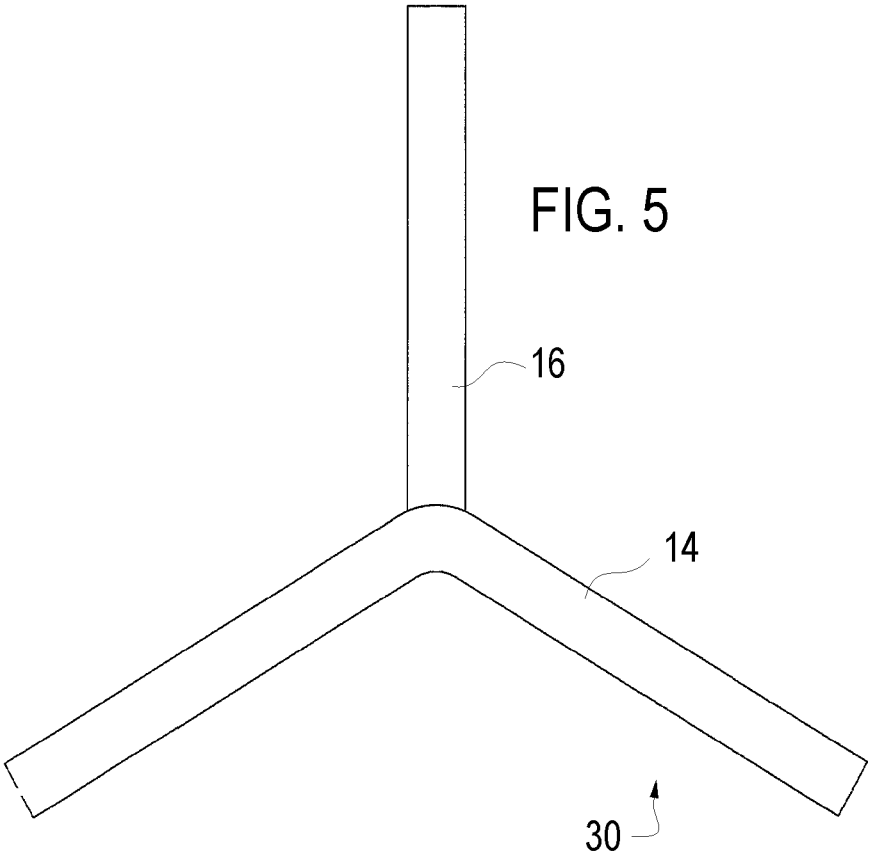
FIG. 5 is a cross-sectional view of the foundation support taken along lines "A-A", shown in FIG. 4A.
Figure 6:
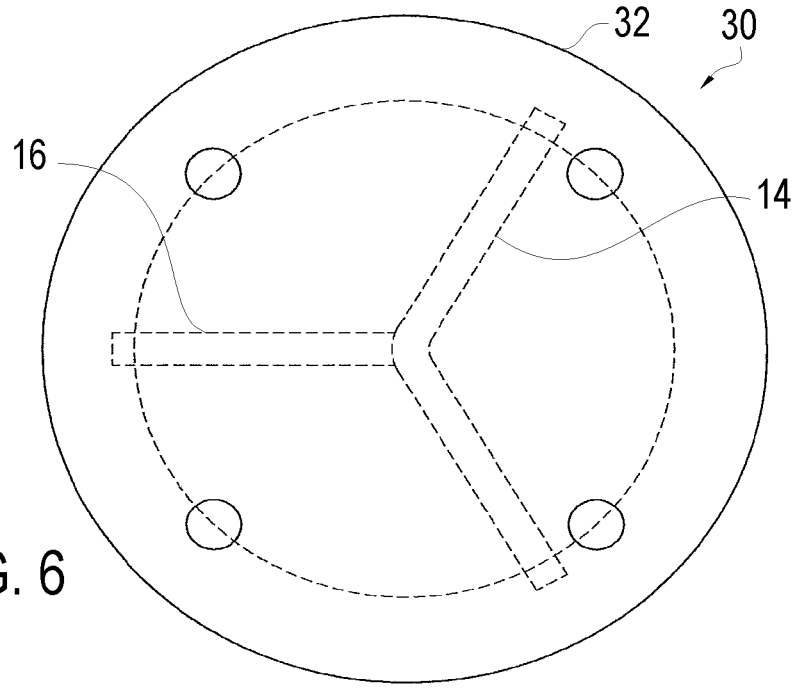
FIG. 6 is a top plan view of the foundation support of FIG. 4A.

For purposes of the description hereinafter, spatial orientation terms, if used, shall relate to the referenced embodiment as it is oriented in the accompanying drawing figures or otherwise described in the following detailed description. However, it is to be understood that the embodiments described hereinafter may assume many alternative variations and embodiments. It is also to be understood that the specific devices illustrated in the accompanying drawing figures and described herein are simply exemplary and should not be considered as limiting.

FIGS. 1-3 illustrate a flat plate foundation support 10, or anchor 10, for supporting and anchoring a ground supported structure according to one embodiment of the present invention. The foundation support 10 extends longitudinally along a central longitudinal axis. A lower portion of the support is adapted to be inserted into a ground surface below the grade 12. The lower portion of the support 10 includes a plurality of flat plates 14 and 16 that are mutually connected along the central longitudinal axis.

As shown in FIGS. 2 and 3, the lower portion is made up of two flat plates 14 and 16, a longer first plate 14 that is bent at an angle in the middle and a second flat plate 16 that is attached to the first plate 14 at the apex angle by a suitable method, such as welding. Each side of the single bent plate 14 forms a "flat" plate 14 extending radially from the center axis. Accordingly, the lower portion of the foundation support 10 is made up of three longitudinal fins (14 and 16) that extend laterally or radially from the central longitudinal axis (corresponding to the apex of the angle of the bent flat plate) and are equally spaced at angles of 120°. It is to be appreciated that the lower portion of the foundation support 10 may be of a variety of different configurations of flat plates having two or more fins.

As shown in FIG. 1A, the flat plates 14 and 16 making up the lower portion of the foundation support 10 are beveled at an angle of 60° at the lower end and as shown in FIG. 1B have sharpened leading edges to facilitate placement of the foundation support 10 into the ground surface 12.

With further reference to FIG. 1, an upper portion of the foundation support 10 is provided for connecting to and supporting the ground supported structure. As shown, the upper portion is a cylindrical pipe 18 that is disposed over a top end of the lower portion so that the upper and lower portions are co-extensive along the central longitudinal axis for a certain length, such as 6 inches shown at 20. An inner surface of the cylindrical pipe 18 is connected to the lateral edges of the flat plates 14 and 16 by a suitable method, such as welding along the lateral edges of the fins in the longitudinal direction.

It is to be appreciated that the foundation support 10 may be of any longitudinal length and the upper and lower portions may be of varying relative longitudinal lengths depending on the conditions of use. Additionally, the flat plates 14 and 16 may also be of varying thickness and lateral lengths extending from the central longitudinal axis and the diameter of the cylindrical pipe of the upper portion may be of a corresponding diameter depending on the conditions of use.

It is also to be appreciated that individual foundation supports may be pre-assembled and then shipped to a construction site for installation. In particular, the individual foundation supports 10 may be inserted into the ground surface individually by using a vibrator or push-it machine to apply vibration to the lower portion of the foundation support 10 while pushing downward on the top end in order to insert the foundation support into the ground 12 beginning with the beveled lower end. It is also to be appreciated that, depending on the application and conditions of the ground surface 12, the foundation support 10 may be inserted into the ground surface 12 without the necessity of pre-drilling a hole in the ground surface 12. Alternatively, the foundation support 10 may be installed in a pre-drilled hole depending on the conditions of the ground surface 12. Additionally, use of the foundation support 10 according to this embodiment substantially eliminates the need for backfilling of soil and/or concrete to complete the foundation, thus saving substantial construction time and costs. A ground supported structure may then be attached to the top of the cylindrical pipe. In operation, one or more foundation supports 10 may be provided to support a single structure.

FIGS. 4-7 illustrate a flat plate foundation support 30, or anchor 30 according to another embodiment of the present invention. As shown, the lower portion of the foundation support 30 is substantially the same as the embodiment of support 10 discussed above with reference to FIGS. 1-3.

Figure 7:
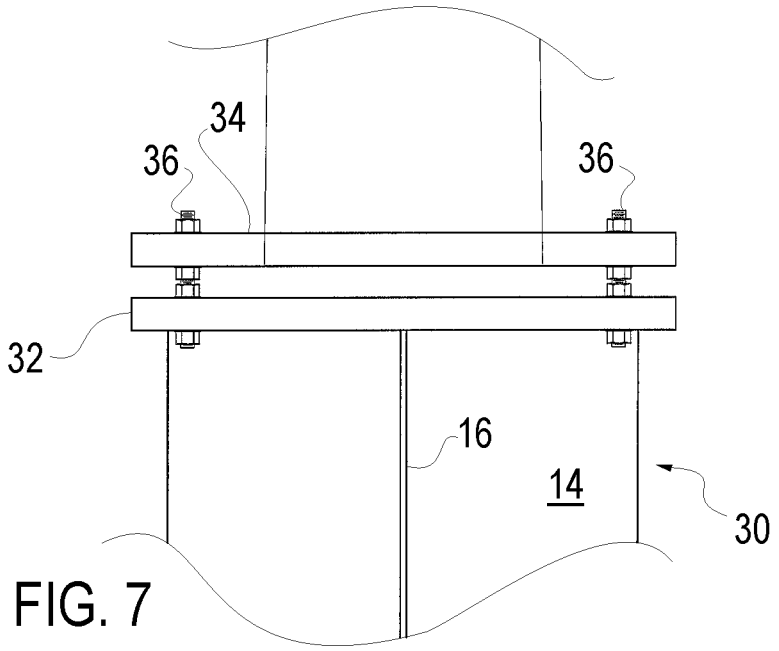
FIG. 7 is a detailed side view of the foundation support of FIG. 4A, illustrating a connection between the foundation support and a ground supported structure.

The upper portion is distinct and comprises a top plate 32 that is disposed on the top end of the lower portion such that the top plate 32 extends across the top edges of the flat plates 14 and 16 of the lower portion, which are disposed flush with the ground surface 12 such that the top plate 32 is disposed on or near the ground surface 12. A ground supported structure is then attached to the top plate. Typically, the ground supported structure will include a mounting plate 34 having a corresponding structure to the top plate 32 of the support foundation 30. The two plates 32 and 34 may then be connected by known methods, such as bolt fasteners 36, as best shown in FIG. 7.

Figure 8A:
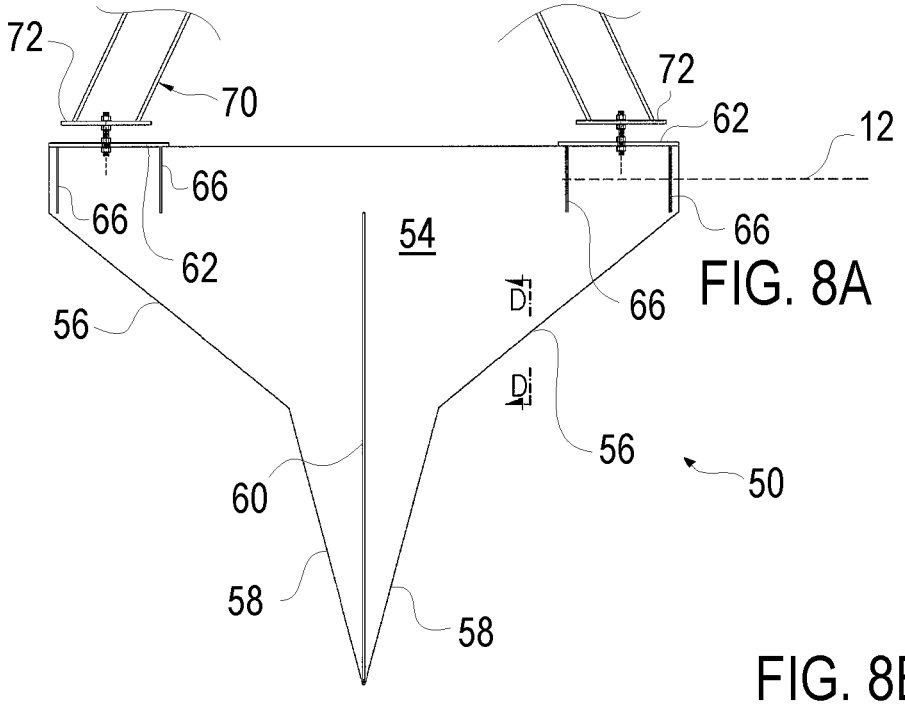
FIG. 8A is a front side view of a flat plate foundation support according to another embodiment of the present invention.
Figure 8B:
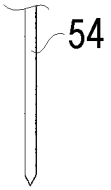
FIG. 8B is an enlarged side view of a single fin of the flat plate foundation support shown in FIG. 8A taken along lines D-D of FIG. 8A.
Figure 9:
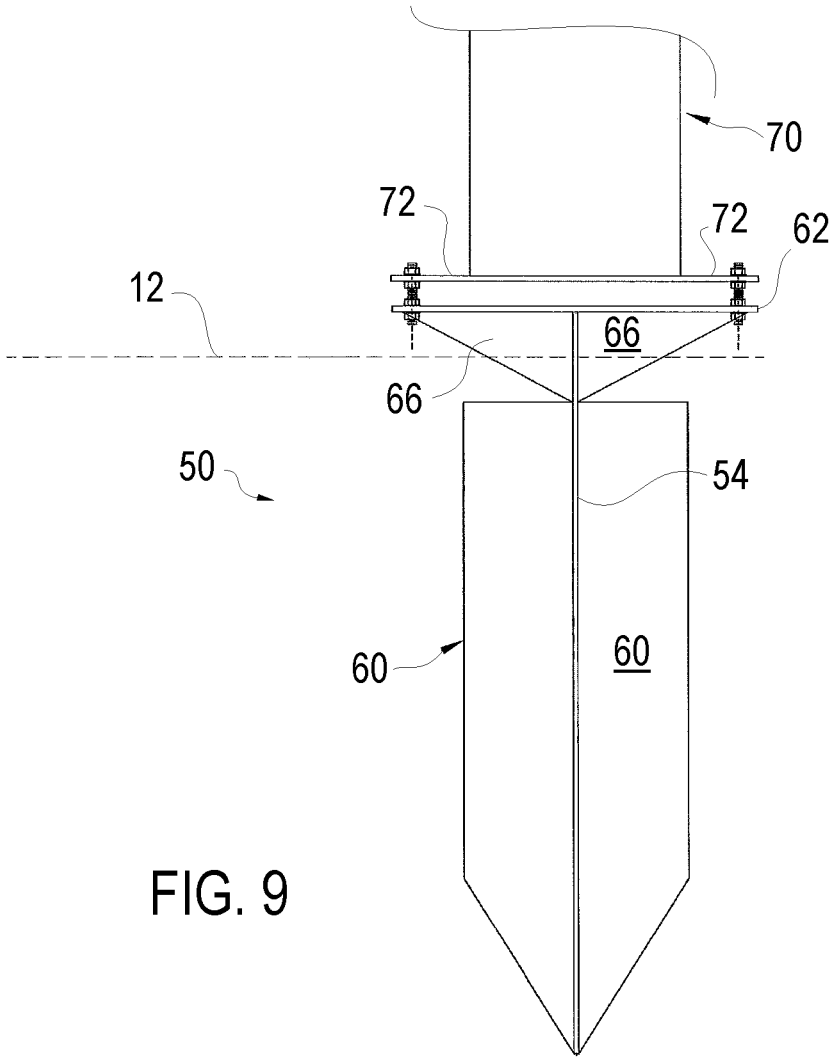
FIG. 9 is a left side view of the flat plate foundation of FIG. 8A.

FIGS. 8-11 illustrate another flat plate foundation support 50, or anchor according to an embodiment of the present invention. As shown in FIGS. 8-10, the lower portion of the foundation support 50 includes an elongated flat plate 54 having two beveled portions. A center portion of the elongated plate 54 is beveled at 56, with respect to the longitudinal axis of the lower portion, at a relatively shallow angle. A bottom portion of the plate 54 is more sharply beveled at 58 with respect to the longitudinal axis. The leading edges of both the center and bottom portions of the elongated plate are sharpened.

The lower portion of the foundation support 50 also includes a pair of side plates 60, or side fins 60, disposed on opposing sides of the elongated plate 54 and connected to the elongated plate 54 along the central longitudinal axis by a known method, such as welding of the plates 60 along the central longitudinal axis. The lower ends of the side plates 60 are also beveled and include sharpened leading edges. It is to be appreciated that the beveled portions and sharpened edges are provided to facilitate the installation of the lower portion of the foundation support 50 without the necessity of pre-drilling or digging of a hole in the ground surface. The length of the side plates 60 along the central longitudinal axis is shorter than the length of the elongated plate 54, such that the side plates 60 are buried in the ground surface 12, while the top end of the elongated plate 54 extends above the ground surface 12.

Figure 11:
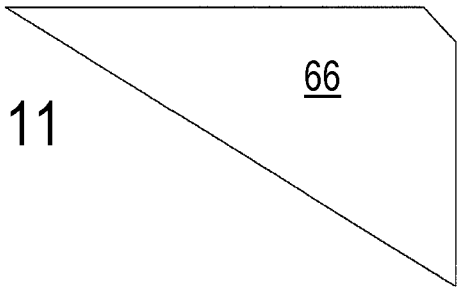
FIG. 11 is a detailed view of a gusset plate for use in the flat plate foundation support of FIG. 8.

As shown in FIGS. 8-10, the upper portion of the support includes a pair of support plates 62 disposed on top of opposing lateral ends of the elongated plate 54. As shown in FIG. 10, the support plates 62 include adjustable mounting holes 64 to facilitate attachment of varying configuration of mounting plates of the ground supported structure. Each support plate 62 may additionally be supported by one or more triangular gussets 66 (four are shown for each plate 62) extending between the elongated plate 54 and the support plate 62, as shown in FIGS. 9 and 11. One structure, such as an A-frame structure 70 shown in FIG. 8, or plural ground supported structures may be anchored by a single foundation support 50 according this embodiment. In particular, each of the legs of the A-frame structure 70 shown in FIG. 8 includes a mounting plate 72 attached to the top plate 62 of the foundation support 50 by one or more fasteners. The A-frame structure supports a solar collector array.

It is to be appreciated that the foundation support 50 shown in FIGS. 8-11 may be of any longitudinal length and the elongated and side plates 54 and 60 may be of varying lateral widths extending from the central longitudinal axis. Additionally, the top plates 62 may also be of varying thickness depending on the conditions of use.

It is also to be appreciated that individual foundation supports 50 may be pre-assembled and then shipped to a construction site for installation. In particular, the individual foundation supports 50 may be inserted into the ground surface individually by using a vibrator or push-it machine to apply vibration to the foundation support 50 while pushing downward on the top end in order to insert the foundation support 50 into the ground 12 beginning with the beveled lower end 58. It is also to be appreciated that, depending on the application and conditions of the ground surface 12, the foundation support 50 may be inserted into the ground surface 12 without the necessity of pre-drilling a hole in the ground surface 12. Alternatively, the foundation support 50 may be installed in a pre-drilled hole depending on the conditions of the ground surface. Additionally, use of the foundation support 50 according to this embodiment eliminates the need for backfilling of soil and/or concrete to complete the foundation, thus saving substantial construction time and costs. A ground supported structure, such as 70, may then be attached to the top plates 62 at the lateral ends of the elongated plate 54, as discussed above.

Figure 13:
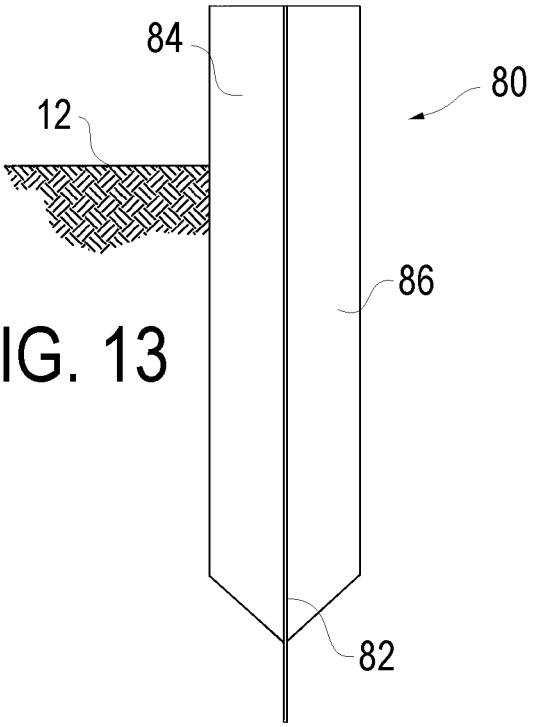
FIG. 13 is a front elevation view of the one-piece, z-shaped flat metal plate foundation support shown in FIG. 12.
Figure 14:
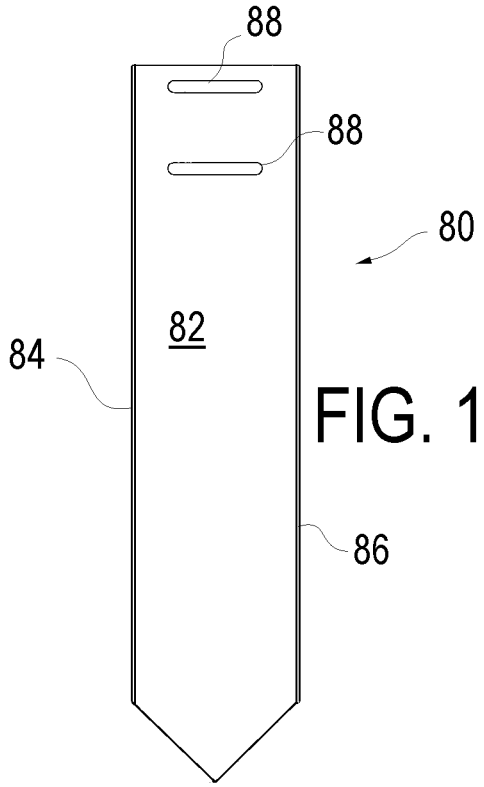
FIG. 14 is a side elevation view of the one-piece, z-shaped flat metal plate foundation support shown in FIG. 12.
Figure 15:
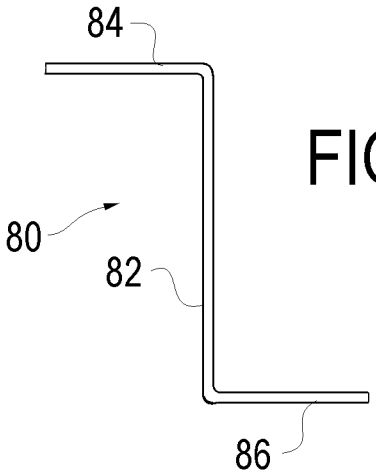
FIG. 15 is a top plan view of the one-piece, z-shaped flat metal plate foundation support shown in FIG. 12.

FIGS. 12-13 illustrate another flat plate foundation support 80, or anchor according to an embodiment of the present invention. Specifically the support 80 is a one-piece, Z shaped steel plate foundation 80. The foundation 80 includes a main plate body 82 extending the longitudinal length of the foundation 80 from a top to a bottom of the foundation 80.

The foundation 80 includes a single rear flange 84 extending at an angle, preferably perpendicular, to the main plate body 82 in a first direction at a rear edge of the main plate body 82, wherein the single rear flange 84 does not extend past the main plate body 82 in the direction opposite the first direction.

The foundation 80 includes a single front flange 86 extending at an angle, preferably perpendicular, to the main plate body 82 in the direction opposite the first direction at a front edge of the main plate body 82, wherein the single front flange 86 does not extend past the main plate body 82 in the first direction.

The foundation 80 includes a plurality of mounting holes 88 at the top of the one-piece metal plate foundation 80 configured for attachment to the structure 100 to be supported. A pair of elongated oval shaped mounting holes in the main body 82 extending at an angle relative to elongated mounting holes on the associated structure 100 give adjustment in two directions for the coupling of the foundation 80 to the structure 100 (i.e horizontal adjustment along mounting holes 88 and vertical adjustment along mounting holes in the structure 100).

In the one one-piece metal plate foundation 80 according to FIGS. 12-15, it is preferred that the rear flange 84 and the front flange 86 extend substantially parallel to each other and having them extend substantially perpendicular to the main plate body 82 is preferred.

The one-piece metal plate foundation 80 according to FIGS. 12-15 preferably provides a bottom of the main plate body 82 which is beveled and wherein a bottom of the rear flange 84 and the front flange 86 are beveled. This construction assists in installation of the foundation 80.

It is to be appreciated that the above-described embodiments of a flat plate foundation supports 10, 30 and 50 may be manufactured according to any technique known to be suitable to those having ordinary skill in the art and may be made from any material known to be suitable to those having ordinary skill in the art. According to one embodiment of the present invention, the flat plate foundation supports 10, 30 and/or 50 are made from steel and individual steel pieces of the foundation support are connected by welding and are pre-assembled and shipped to a construction site ready for installation.

A preferred method of forming the one-piece Z-shaped steel plate foundation 80 of FIGS. 12-15 comprising the steps of: providing a single flat steel plate wherein a central portion of the single flat plat forms the main plate body 82 extending the longitudinal length of the foundation 80 from a top to a bottom of the foundation 80; bending the single rear flange 84 extending at an angle from the main plate body 82 in a first direction at a rear edge of the main plate body; and bending the single front flange 86 extending at an angle from the main plate body 82 in the direction opposite the first direction at a front edge of the main plate body 82. As noted above, preferably the rear flange 84 and the front flange 86 are bent to extend substantially parallel to each other and to extend substantially perpendicular to the main plate body 82. The method of forming the one-piece metal plate foundation 80 according to FIGS. 12-15 may further include the step of hot dip galvanizing the one-piece metal plate foundation. The method of forming the one-piece metal plate foundation 80 according to FIGS. 12-15 may further include the step of beveling a bottom of the main plate body and of beveling a bottom of both the rear flange 84 and the front flange 86.

According to another embodiment of the present invention, the flat plate foundation supports 10, 30, 50 and/or 80 may be installed by a metal foundation push-it and installation apparatus of the type disclosed in U.S. Pat. Nos. 5,660,504, 5,733,068, and 5,944,452, all of which are incorporated herein by reference.

While several embodiments of a flat plate foundation support were described in the foregoing detailed description, those skilled in the art may make modifications and alterations to these embodiments without departing from the scope and spirit of the invention. Accordingly, the foregoing description is intended to be illustrative rather than restrictive. The invention described hereinabove is defined by the appended claims and all changes to the invention that fall within the meaning and the range of equivalency of the claims are embraced within their scope.

What is claimed is:

1. A one-piece metal plate foundation comprising:

A) a main plate body extending a longitudinal length of the foundation from a top edge surface of the main plate body to a bottom end of the main plate body, the main plate body further including:

i) a longitudinal centerline extending along the longitudinal length of the foundation from the top edge surface of the main plate body to the bottom end of the main plate body;

ii) a rear side edge of the main plate body on one side of the longitudinal centerline and extending from the top edge surface of the main plate body in a direction parallel to the longitudinal centerline;

iii) a front side edge of the main plate body on a side of the longitudinal centerline opposite the side of the rear side edge of the main plate body and extending from the top edge surface of the main plate body in a direction parallel to the longitudinal centerline;

iv) a bottom edge surface extending between the rear side edge of the main plate body and the front side edge of the main plate body;

v) first and second elongated mounting holes each having upper and lower linear portions extending parallel to the top edge surface of the main plate body, the second elongated mounting hole located between the first elongated mounting hole and the top edge surface of the main plate body;

B) a single rear flange extending at an angle from the rear side edge of the main plate body in a first flange direction at the rear side edge of the main plate body, wherein the single rear flange does not extend past the main plate body in a direction opposite the first flange direction, the single rear flange further including:

i) a top edge surface of the single rear flange which extends from and is coplanar with the a top edge surface of the main plate body;

ii) an inner side edge of the single rear flange extending from one end of the top edge surface of the single rear flange and which is adjacent to and coextensive with the rear side edge of the main plate body;

iii) an outer side edge surface of the single rear flange extending from an end of the top edge surface of the single rear flange opposite from the one end from which the inner side edge of the single rear flange extends, wherein the outer side edge surface of the single rear flange extends from the top edge surface of the single rear flange in a direction parallel to the longitudinal centerline and extends for a distance less than a longitudinal distance of the inner side edge of the single rear flange;

iv) a bottom side edge surface of the single rear flange extending between the outer side edge surface of the single rear flange and the inner side edge of the single rear flange;

C) a single front flange extending at an angle from the front side edge of the main plate body at the front side edge of the main plate body in a direction opposite the first flange direction of the single rear flange, wherein the single front flange does not extend past the main plate body in the first flange direction, the single front flange further including:

i) a top edge surface of the single front flange which extends from and is coplanar with the a top edge surface of the main plate body;

ii) an inner side edge of the single front flange extending from one end of the top edge surface of the single front flange and which is adjacent to and coextensive with the front side edge of the main plate body;

iii) an outer side edge surface of the single front flange extending from an end of the top edge surface of the single front flange opposite from the one end from which the inner side edge of the single front flange extends, wherein the outer side edge surface of the single front flange extends from the top edge surface of the single front flange in a direction parallel to the longitudinal centerline and extends for a distance less than a longitudinal distance of the inner side edge of the single front flange;

iv) a bottom side edge surface of the single front flange extending between the outer side edge surface of the single front flange and the inner side edge of the single front flange;

D) wherein the top edge surface of the main plate body and the top edge surface of the single rear flange and the top edge surface of the single front flange are co-planar and contiguous and combine to form a continuous, unbroken bearing surface for the foundation extending from the outer side edge surface of the single rear flange to the outer side edge surface of the single front flange.

2. The one-piece metal plate foundation according to claim 1, wherein the single rear flange and the single front flange extend in directions which are substantially parallel to each other.

3. The one-piece metal plate foundation according to claim 2, wherein the single rear flange and the single front flange extend substantially perpendicular to the main plate body.

4. The one-piece metal plate foundation according to claim 3, wherein the one piece metal plate foundation is formed from a single flat steel plate bent to form the single rear flange and the single front flange.

5. The one-piece metal plate foundation according to claim 3, wherein the one-piece metal plate foundation is galvanized.

6. The one-piece metal plate foundation according to claim 5, wherein the bottom edge surface of the main plate body includes a rear bottom edge surface portion extending between the rear side edge of the main plate body and the longitudinal centerline of the main plate body and a front bottom edge surface portion extending between the longitudinal centerline of the main plate body and the front side edge of the main plate body, and wherein a length of the main plate body along the longitudinal centerline is greater than a length of the main plate body along the rear side edge or the front side edge of the main plate body.

7. The one-piece metal plate foundation according to claim 6, wherein the first and second elongated mounting holes are configured for attachment to a structure to be supported.

8. A method of forming a one-piece metal plate foundation comprising providing a planar one piece steel plate and bending a rear side of the steel plate to form a single rear flange extending in a first flange direction from a main plate body of the steel plate and bending a front side of the steel plate to form a single front flange extending in direction opposite to the first flange direction from a main plate body of the steel plate, and wherein the foundation includes:

A) the main plate body extending a longitudinal length of the foundation from a top edge surface of the main plate body to a bottom end of the main plate body, the main plate body further including:

i) a longitudinal centerline extending along the longitudinal length of the foundation from the top edge surface of the main plate body to the bottom end of the main plate body;

ii) a rear side edge of the main plate body on one side of the longitudinal centerline and extending from the top edge surface of the main plate body in a direction parallel to the longitudinal centerline;

iii) a front side edge of the main plate body on a side of the longitudinal centerline opposite the side of the rear side edge of the main plate body and extending from the top edge surface of the main plate body in a direction parallel to the longitudinal centerline;

iv) a bottom edge surface extending between the rear side edge of the main plate body and the front side edge of the main plate body;

v) first and second elongated mounting holes each having upper and lower linear portions extending parallel to the top edge surface of the main plate body, the second elongated mounting hole located between the first elongated mounting hole and the top edge surface of the main plate body;

B) the single rear flange extending at an angle from the rear side edge of the main plate body in the first flange direction at the rear side edge of the main plate body, wherein the single rear flange does not extend past the main plate body in a direction opposite the first flange direction, the single rear flange further including:

i) a top edge surface of the single rear flange which extends from and is coplanar with the a top edge surface of the main plate body;

ii) an inner side edge of the single rear flange extending from one end of the top edge surface of the single rear flange and which is adjacent to and coextensive with the rear side edge of the main plate body;

iii) an outer side edge surface of the single rear flange extending from an end of the top edge surface of the single rear flange opposite from the one end from which the inner side edge of the single rear flange extends, wherein the outer side edge surface of the single rear flange extends from the top edge surface of the single rear flange in a direction parallel to the longitudinal centerline and extends for a distance less than a longitudinal distance of the inner side edge of the single rear flange;

iv) a bottom side edge surface of the single rear flange extending between the outer side edge surface of the single rear flange and the inner side edge of the single rear flange;

C) the single front flange extending at an angle from the front side edge of the main plate body at the front side edge of the main plate body in a direction opposite the first flange direction of the single rear flange, wherein the single front flange does not extend past the main plate body in the first flange direction, the single front flange further including:

i) a top edge surface of the single front flange which extends from and is coplanar with the a top edge surface of the main plate body;

ii) an inner side edge of the single front flange extending from one end of the top edge surface of the single front flange and which is adjacent to and coextensive with the front side edge of the main plate body;

iii) an outer side edge surface of the single front flange extending from an end of the top edge surface of the single front flange opposite from the one end from which the inner side edge of the single front flange extends, wherein the outer side edge surface of the single front flange extends from the top edge surface of the single front flange in a direction parallel to the longitudinal centerline and extends for a distance less than a longitudinal distance of the inner side edge of the single front flange;

iv) a bottom side edge surface of the single front flange extending between the outer side edge surface of the single front flange and the inner side edge of the single front flange;

D) wherein the top edge surface of the main plate body and the top edge surface of the single rear flange and the top edge surface of the single front flange are co-planar and contiguous and combine to form a continuous, unbroken bearing surface for the foundation extending from the outer side edge surface of the single rear flange to the outer side edge surface of the single front flange.

9. The method of forming a one-piece metal plate foundation according to claim 8, wherein the single rear flange and the single front flange extend in directions which are substantially parallel to each other.

10. The method of forming a one-piece metal plate foundation according to claim 9, wherein the single rear flange and the single front flange extend substantially perpendicular to the main plate body.

11. The method of forming a one-piece metal plate foundation according to claim 10, wherein the one-piece metal plate foundation is galvanized.

12. The method of forming a one-piece metal plate foundation according to claim 11, wherein the bottom edge surface of the main plate body includes a rear bottom edge surface portion extending between the rear side edge of the main plate body and the longitudinal centerline of the main plate body and a front bottom edge surface portion extending between the longitudinal centerline of the main plate body and the front side edge of the main plate body, and wherein a length of the main plate body along the longitudinal centerline is greater than a length of the main plate body along the rear side edge or the front side edge of the main plate body.

13. The method of forming a one-piece metal plate foundation according to claim 12, wherein the first and second elongated mounting holes are configured for attachment to a structure to be supported.

* * * * *